US005447384A

United States Patent [19]

Urso et al.

[11] Patent Number: 5,447,384

[45] Date of Patent: Sep. 5, 1995

[54] SERIAL PRINTER HAVING PRINTING SUPPORT CONVEYING LID

[75] Inventors: Paolo Urso, Parabiago; Emilio Pellicano, Milan, both of Italy

[73] Assignee: Bull HN Information Systems Italia S.p.A., Caluso, Italy

[21] Appl. No.: 281,837

[22] Filed: Jul. 28, 1994

[30] Foreign Application Priority Data

Oct. 20, 1993 [EP] European Pat. Off. ..... 9380422

[51] Int. Cl.[6] ..... B41J 13/10

[52] U.S. Cl. ..... 400/645.4; 400/642

[58] Field of Search ..... 400/642, 643, 645, 645.4, 400/645.5, 600, 645.1

[56] References Cited

U.S. PATENT DOCUMENTS 2,748,916 6/1956 Duke ..... 400/642
4,437,780 3/1984 Weber et al. ..... 400/642
5,170,184 12/1992 Hanabusa et al. ..... 400/645

FOREIGN PATENT DOCUMENTS 0052408 5/1982 .
0358192 3/1990 European Pat. Off. .
0514155 11/1992 European Pat. Off. .
2408461 6/1979 France .

OTHER PUBLICATIONS

Patent Abstracts of Japan, vol. 10, No. 231 (M-506) (2287) 12 Aug. 1986 and JP-A-61 064 475 (Nec Corp.) 2 Apr. 1986 *abraact*

*Primary Examiner*—Ren Yan
*Attorney, Agent, or Firm*—Rosen, Dainow & Jacobs

[57] ABSTRACT

Serial printer having a printing support conveying lid formed by a rigid plate hinged to the printer and extending for the whole lenght of the print line the plate being provided with a resilient lip having a free edge located immediately dowstream of the print line, spaced apart from a platen for a rest position of the lid and in contact with the platen for an active position of the lid, the lid being held in rest position by resilient bias means and driven in working position by the interference with the lid of pressure pads steady with the printing head slidable along the print line, when the printing head is located along the print line in a position other than a travel end position, in which interference does not occurr.

4 Claims, 3 Drawing Sheets

SERIAL PRINTER HAVING PRINTING SUPPORT CONVEYING LID

BACKGROUND OF THE INVENTION

The present invention relates to a serial printer provided with a printing support conveying lid.

Impact dot matrix serial printers re more and more used in the modern data processing systems.

In such printers the printing support managing functions are performed, as much as possible, in automatic way, without need of operator manual intervention.

Printing on supports of different kind, such as continous, multiple or single copy forms and single sheets is also provided.

The printing support must be precisely led to and away from a printing platen, extended transversely to the movement direction of the printing support, so as to be inserted between the platen and a printing head, movable along the platen in close proximity thereto.

The perfect contact of the printing support to the platen is of essence for obtaining reliable operation, good printing quality and low level of printing noise.

DESCRIPTION OF THE PRIOR ART

To meet this requirement printing devices are known where a rotating platen, cooperating with pressure rollers, performs the driving function for single sheets.

These devices may be easily combined with mechanisms which move away from and approach the pressure rollers to the platen, in order to allow for the loading of single sheets, but these devices are unsuitable for loading of continuous forms.

In order to feed continous forms, particularly multiple copy forms, fanfold bent, it must be resorted to pin tractors which are preferably located downstream of the platen and pull the form.

The tractors may be combined in pairs to perform a pull on the form, downstream of the platen and a push action toward the platen upstream of it.

The automatic loading of the continuous forms is, in such cases, unfeasible and the severing of a printed portion of the form from the residual portion is performed by cutting or tearing the form downstream of the tractors, so that the platen is permanently engaged with the residual continuous form.

Recently multifunctional printers have been proposed which can alternatively print on both single sheets and continuous form.

In these printers the rotating platen, coupled to pressure rollers, provides to feed the single sheets and a tractor pair, located upstream of the platen, provides to feed the continuous form.

In this case the tractors works in push mode and by suitable reversing their motion, once the printed portion of the module is severed from the residual portion, it becomes possible to free the printing platen from the presence of the residual module and to allow for the feeding and printing of one or more discrete sheets.

This kind of printers has the unconvenient that the continuous form in output from the tractors is pratically free and is not forced to a perfect contact with the platen surface, thus causing an unsatisfactory printing quality and remarkable printing noise.

SUMMARY OF THE INVENTION

These unconvenients are overcome by the serial printer according to the present invention which printer is provided with a printing support conveying lid extending along the platen, the lid being rotatably mounted in the printer according to a rotation axis parallel to the printing line and comprising a resilient lip extending along the printing line immediately downstream of it.

The lid is biased in a rest position by a resilient bias means and when in the rest position the resilient lip is spaced apart from the platen.

Steady with the printing head, interference means are provided which interfere with the lead for every position of the printing head other than at least an end stroke position of the printing head.

The interference causes a rotation of the lid which brings the lip in contact with the platen thus assuring for the whole extension of the lip along the platen, the contact to the platen of a printing support interposed thereto.

When the printing head is located at the stroke end position the lid, in rest position, with the lip spaced apart from the platen allows for an easy insertion, even automatic, of the printing support between lip and platen.

According to another aspect of the present invention, the interference which causes the actuation of the lid is obtained with pressure wings located at one side and the other of the nose of a printing head, hence in close proximity to the zone where the printing operation is performed, the wings directly interfering with the resilient lip.

The lip has an end cut relief so as to prevent interference for a stroke end position of the printing head.

A structure effective, simple in construction and unsexpensive results.

According to a further aspect of the present invention the lid is provided with an intermediate support, removably mounted in the printer so as to allow for an easy removal of the lid, which may be provided as an optional, added to the printer in the only cases requiring it.

It is therefore possible to offer the user printers which, departing from a monofunctional base model, can be converted in efficient multifunctional printers by adding pus ode printing support feeding devices and a conveying lid according to the invention.

The lid assures low noise operation and excellent printing quality without hampering the proper feeding of the printing support and its automatic insertion between platen and conveying lid.

BRIEF DESCRIPTION OF THE DRAWINGS

The features and the advantages of the present invention will appear more clearly from the following description of a preferred form of embodiment and from the enclosed drawings where.

DESCRIPTION OF A PREFERRED EMBODIMENT

Figure 1:
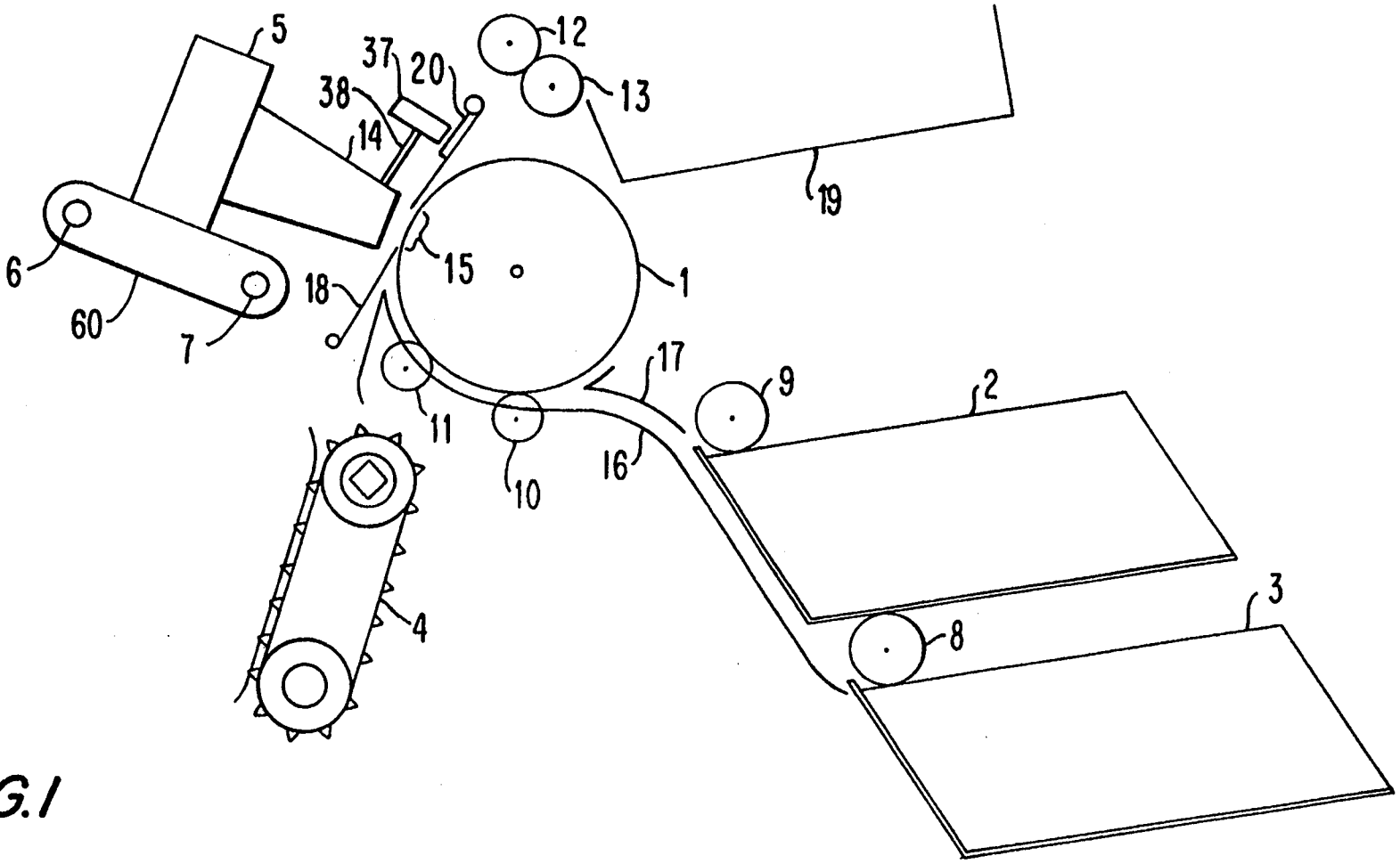
FIG. 1 is a schematic section view perpendicular to the platen, of a multifunctional printer provided with conveying lid.

Referring to FIG. 1 a dot matrix serial printer comprises a cylindrical rotating platen 1, one or more single sheet feeding hoppers 2,3, a pair of tractors 4, for feeding a continuous form, a printing head 5 supported by a carriage 60, slidable on guiding bars 6,7, parallel to the axis of the cylindrical platen and a plurality of selectively actuated feeding rollers 8,9,0,,2,3.

The printing head 5 has a printing nose 4, facing the platen closely to its surface and through well known means (printing needles, ink jet nozzles and like), forms an image on a printing support interposed between nose 14 and platen 1.

The displacement of the printing head 5 along the platen defines, on the platen surface, a print line 5 having a lenght corresponding to the travel of the printing head and a width related to the position and size of the printing elements.

The operation of this kind of printer is well known.

A single sheet, drawn from hopper 2 (or 3) by activating the picking up roller 9 (or 8) is conveyed by guiding chutes 16,17 to the platen 1 and, interposing between platen, pressure roller 10 and subsequently roller 11 is driven up to the print line 15.

Just before reaching the print line the single sheet is pressed against the platen by a guiding pad which converges toward the platen in the feeding direction of the single sheet forming with the platen a dihedral lead easing the insertion of the sheet between the pad 18 and the platen 15.

By combining the step by step feeding of the sheet and the transverse movement of the printing head a plurality of characters or image lines are subsequently printed on the sheet.

In the course of its advancement the sheet interposes between two driving rollers 12, 13 which push it in a collection drawer 19.

Quite similar is the operation of the printer in case a continuous form, possibily a multiple copy form, has to be printed. The form, inserted in the tractors 4, is pushed toward the print line 15, driven by pad 18, printed and inserted between rollers 12,13.

By manually or automatically cutting the form, the operation being generally performed by a cutter located immediately dowstream of the rollers 12,13, the residual portion of the form which is present between the print line 15 and the roller pair 12,13 may be drawn back by operating the tractors 4 and the rollers 12,13 in reverse direction so as to bring the cut edge of the form in proximity of the tractors 4.

By this operation the print line is made free from the presence of the form and feeding of one or more single sheets and their transit, on the print line is made possible.

To resume printing of the continuous form, it must be fed forward up to the print line ensuring that the form be in contact with the platen non only upstream of the print line, where it is guided by pad 18, but also immediately dowstream of the print line.

This is required in order to obtain a good printing quality and, in case of impact printers, in order to avoid printing support vibrations which are cause of remarkable noise.

Figure 2:
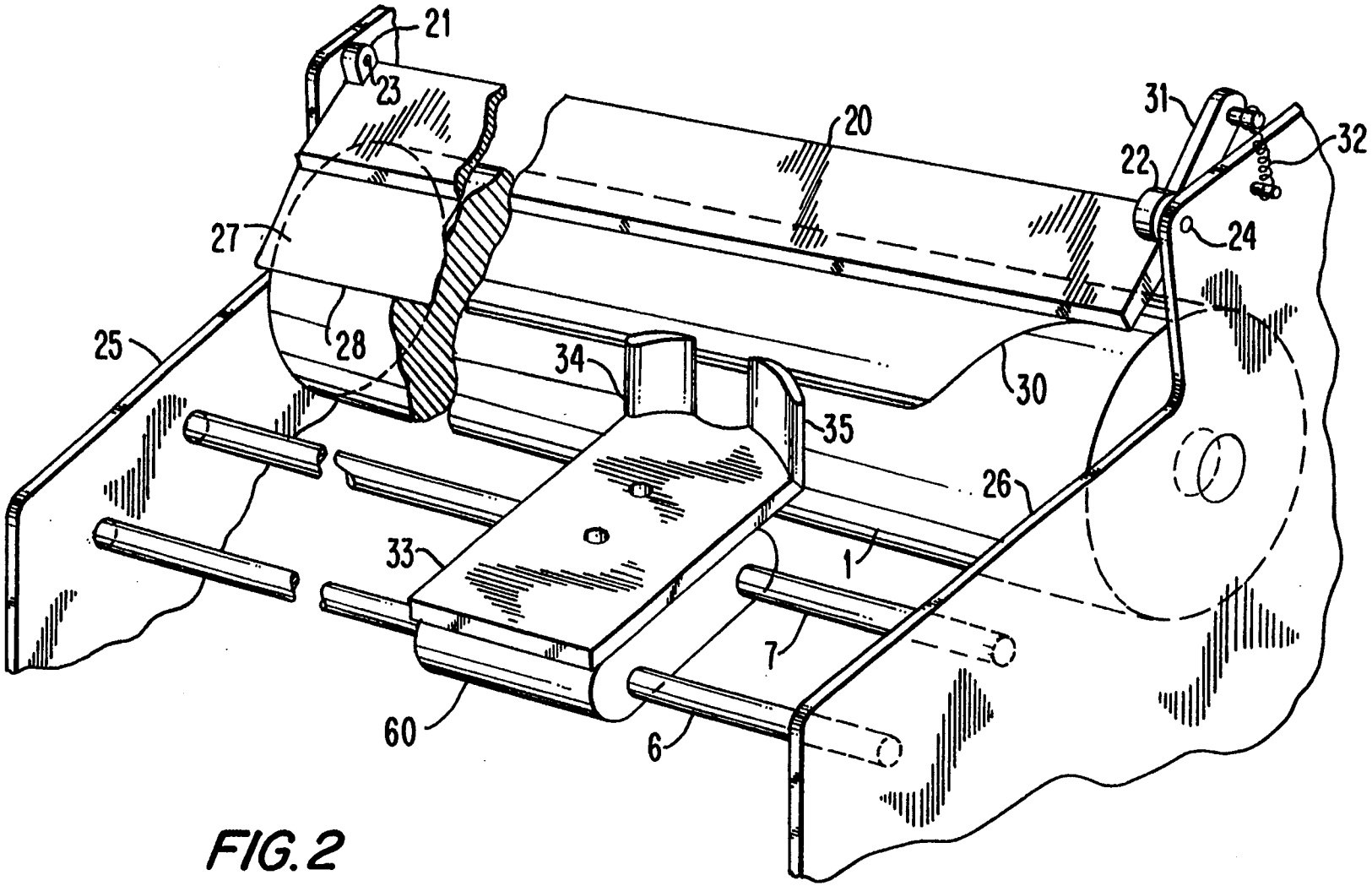
FIG. 2 shows in perspective view the mechanical elements of the printer of FIG. 1 which elements are specifical object of a preferred form of embodiment of the invention.

To this purpose as more readily shown in FIG. 2, the printer is provided with a conveying lid formed by a rigid plate 20 extending in the platen direction and hinged at its ends by bushing 21,22 and pins 23,24 to the side plate 25,26 of the printer frame.

The plate 20 extends for the whole length of the platen and is coupled to a resilient lip 27 extending with a free edge up to the print line, substantially for the whole length of the print line.

An end of the lip 27 has a recessing cut 30 which gradually radiuses the free edge 28 to the plate 20.

Preferably the lip 27 is obtained from transparent plastic material such as polyester, so as to enable visibility of the printed support, but may also be formed by a suitably thin metal blade.

Plate 20 is provided with an arm 31 in opposition to the lip 28.

A bias spring 32 having ends fixed to arm 31 and side plate 26 respectively, biases the plate 20 in a rest position holding lip 27 spaced apart from the platen 1.

The carriage 60 of the printer comprises a platform 33 supporting the printing head.

In FIG. 2 the printing head is not shown for sake of clearness.

The platform 33 extends toward the platen 1 and is ended in two wings 34,35 vertically extending with a suitably rounded profile.

The wings are spaced apart by a vertical slot intended for insertion therein of the printing head nose 14.

The two wings 34,35 are in close proximity of the platen at the print line.

When the printer carriage, slidable on the bars 6,7 is in a position spaced apart from side plate 26, the upper end of wings 34,35 interferes with the free edge 28 of lip 27 and, opposing to the action of spring 32, pushes lip 27 against platen 1 near the printing line, causing a rotation of plate 20 such that the whole free edge 28 of lip 27 is set in contact with the platen and exerts a pressure distributed on the whole width of a printing support interposed between lip 27 and platen 1.

On the contrary, when carriage 60 is located near side plate 26, the recessing cut 30 of lip 27 prevents interference of wings 34,35 with lip 27 and the lip remains in rest position allowing for an easy insertion of a printing support between lid and platen.

In order to load both the continuous form and the single sheets it suffices that an automatic control system provides to control the motor means which operate the carriage and the feeding devices of the printing supports so that the carriage dislacement against the side plate 26 is followed by the feeding of the printing support up to and slighty beyond the print line.

With a subsequent movement of the carriage and the print head along the print line the conveying lid is operated and the printing of a plurality of lines can be performed without need of returning the printing carriage to the travel end position in order to enable the printing support feeding between the printing operation of a line and the next following one.

As shown in FIG. 1 plate 20 and lip 27 usefully perform as guiding member which conveys the printing support toward the driving rollers 12 and 13.

FIG. 2 is only a preferred form of embodiment and several modification can be imparted.

The use of two wings or pads such as 35,36 for actuation of the lid is not mandatory, although preferable and a single pad such as 34 sufficies.

Further the actuation of the lid may be performed by acting on plate 20 rather than on lip 27.

For instance, as schematically shown in FIG. 1, a pressure roller 37 rotatably mounted on a pivot 38, perpendicular to the print line and steady with the printing head, may roll on plate 20 and oppose to the action of a bias spring or more generally of resilient biasing means.

In this case it is plate 20 which has a recessing cut, similar or functionally equivalent to cut 30, to enable the lid to take a rest position when the carriage is moved in proximity of one of the side plates.

It is further clear that the lid may be mounted on the printer frame and biased in rest position by means other than those described.

For instance it is possible to use as a substitute for bushing 21,22 and pins 23,24 inserted into the printer side plates, torsion springs fixed to the side plates and to the ends of the lid, the springs providing at the same time to axially position the lid with rotating freedom around an axis, and to bias the lid in rest position.

According to a further aspect of the present invention the lid is removably mounted to the frame so as to form an optional device which can be easily installed in printer models, together with paper tractors, optional they too, so as to obtain multifunctionality in the printing support feeding or even only with the purpose of easing maintenance operations by its removal.

Figure 3:
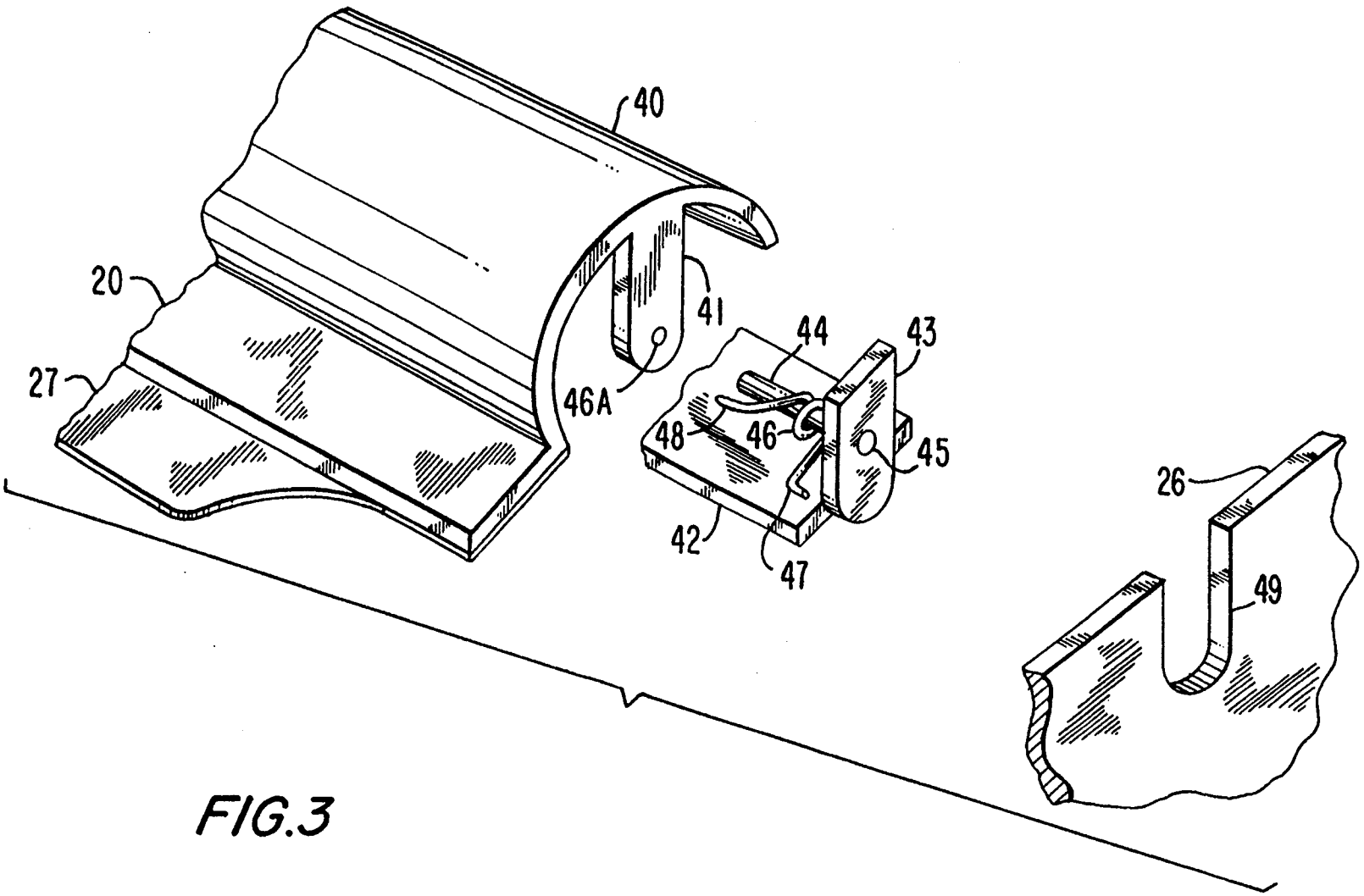
FIG. 3 shows in perspective exploded view an alternative embodiment of conveying lid for the printer of FIG. 1.

In this case as shown in the partial exploded view of Figure 3, the lid is formed by a plate 20 extending in semicylindrical body 40 having two radial brackets, one of which, 41, is shown.

A rod 42, housed in the semicylindrical body, is provided too with end brackets, one of which 43 is shown in the Figure. The rod forms an intermediate support for the lid.

A pin 44 inserted in a seat 45 of bracket 43 and in a corresponding seat 46A of bracket 41, hinges the lid to rod 42 and allows for relative rotation of the two elements.

A coil spring 46, wound on pin 44, has two ends 47,48 extending to interfere with rod 42 (or bracket 43) and the semicylindrical body 40, so as to bias the lid with a torque assuring a rest position of the lid relative to the rod.

The rod 42 or, as shown in the FIG. 3, the bracket 43 is restrained in an indentation 49 of the side plate 26 which provides a stable and predefined position of the rod in the printer and at the same time allow for an easy installation of the set lid-rod.

The same structure is obviously provided at the opposed end of the set.

Other modifications are possible: for instance pin 44 and the corresponding pin at the opposed end of the set may be substituted by a single cylindrical rod, steady with bracket 43 (and with the corresponding bracket at the opposed end of the set) thus rendering superfluous the rod 42, whose function is performed by the cylindrical rod.

In this case the cylindrical rod may operate as hinge pin rotatably supporting driving rollers such as rollers 12 of FIG. 1.

We claim:

1. A serial printer comprising a cylindrical platen defining a print line, a print head mounted to be displaceable along said print line at a predetermined distance from said platen and between two end positions of said print line, means for feeding a print medium inbetween said print head and said platen and in a direction perpendicular to said print line, and means for guiding the print medium during feeding and printing, said means for guiding comprising:

a print medium guiding lid extending along said print line in a spaced relationship to said feeding means and said print line, said lid being hingedly mounted in the printer with a rotational axis parallel to said print line, said lid having a resilient lip extending along the entire length of said print line except for a zone adjacent one of said end positions of said print line and being positioned immediately downstream of said print line in the feeding direction of the print medium, resilient means for pivotally biasing said lid to a rest position in which said resilient lip is spaced apart from said platen, and interference means fixedly mounted on said print head and moving with said print head for continuously pressing said lid in a direction against the biasing force of said resilient means so as to bring said lip in contact with said platen for the entire extension of said lip along said print line, said interference means is out of contact with said lid when said print head is positioned in said zone.

2. A serial printer as claimed in claim 1, said interference means comprising a pressure pad pressing said lid, said lip having a recess cut at one of said end positions, said recess cut preventing contact of said pressure pad with said lip when said print head is in said one end position.

3. A serial printer as claimed in claim 2, further comprising an intermediate support removably mounted in said printer for supporting said lid.

4. A serial printer as claimed in claim 2, wherein said print head is a needle type print head having a nose portion, said interference means comprising two spaced pressure pads between which said nose portion of said print head is positioned.

* * * * *

UNITED STATES PATENT AND TRADEMARK OFFICE

CERTIFICATE OF CORRECTION

PATENT NO. : 5,447,384

DATED : September 5, 1995

INVENTOR(S) : Paolo Urso and Emilio Pellicano

It is certified that error appears in the above-indentified patent and that said Letters Patent is hereby corrected as shown below:

Title Page, after "[30] Foreign Application Priority Data Oct. 20, 1993 [EP] European Pat. Off." delete "9380422" and insert --93830422.7--.

Signed and Sealed this

Twelfth Day of December, 1995

*Attest:*

*Attesting Officer*

BRUCE LEHMAN

*Commissioner of Patents and Trademarks*